US005149089A

United States Patent [19]

Zelinski

[11] Patent Number: 5,149,089

[45] Date of Patent: Sep. 22, 1992

[54] METHOD OF LOCATING GRIPPING HOLES IN BOWLING BALL

[76] Inventor: George Zelinski, 17311 McCarron Rd., Lockport, Ill. 60441

[21] Appl. No.: 673,229

[22] Filed: Mar. 21, 1991

Related U.S. Application Data

[62] Division of Ser. No. 612,819, Nov. 14, 1990, Pat. No. 5,046,731.

[51] Int. Cl.[5] ..... A63B 37/06

[52] U.S. Cl. ..... 273/63 E; 29/899

[58] Field of Search ..... 273/63 E, 63 D, 63 R, 273/63 B, 63 C, 63 F, 63 G; 40/327; 29/899, 899.1

[56] References Cited

U.S. PATENT DOCUMENTS 4,121,828 10/1978 Amburgey ..... 273/63 E 4,913,429 4/1990 Fabanich ..... 273/63 E

*Primary Examiner*—George J. Marlo

*Attorney, Agent, or Firm*—Potthast & Ring

[57] ABSTRACT

A bowling ball having a mass of preselected density and a spherical surface equidistant from the center of the mass. The improvement being a weight block of a greater density than the preselected density in which the weight block has a first elongate section having a pair of opposite ends with an intermediate portion therebetween adjacent the surface of the ball and another elongate section having an axis of symmetry extending generally transverse of the first elongate section and extending from the intermediate portion and located between the center of the spherical mass and the first elongate section. Further, this invention includes a method for marking the center of the spherical mass and center axis of symmetry of the weight block on the surface of the ball and the plane of symmetry of the elongate weight block on the surface of the ball. Finally, the invention includes a method of determining the location of the plane of symmetry of the weight block and drilling the thumb and finger holes into the ball around the center axis of the weight block and having a preselected angular relationship to the plane of symmetry of the weight block to achieve a desired breaking point for the ball.

10 Claims, 1 Drawing Sheet

Fig. 1
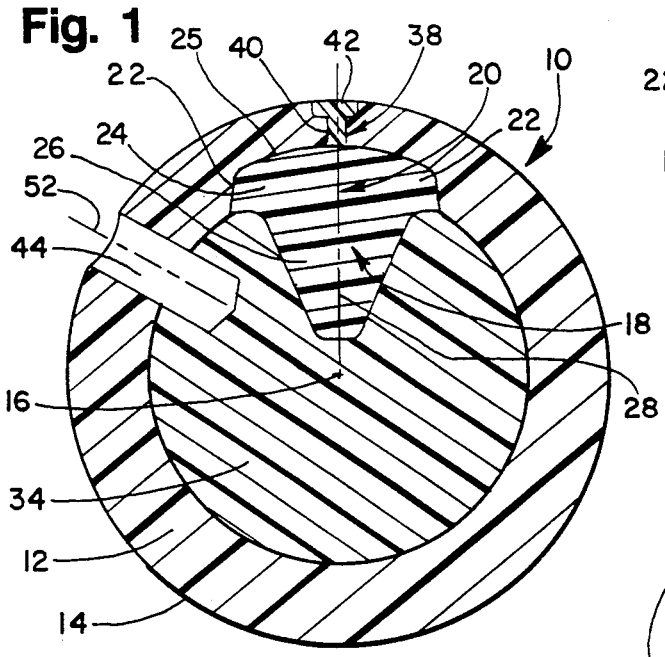
Fig. 2
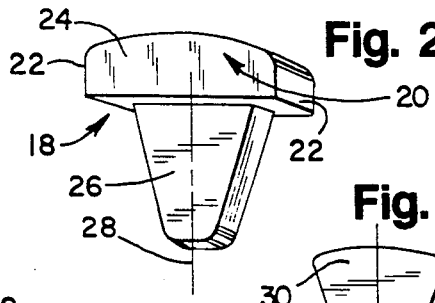
Fig. 3
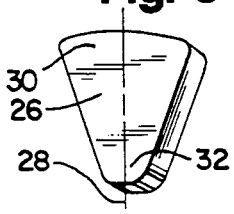
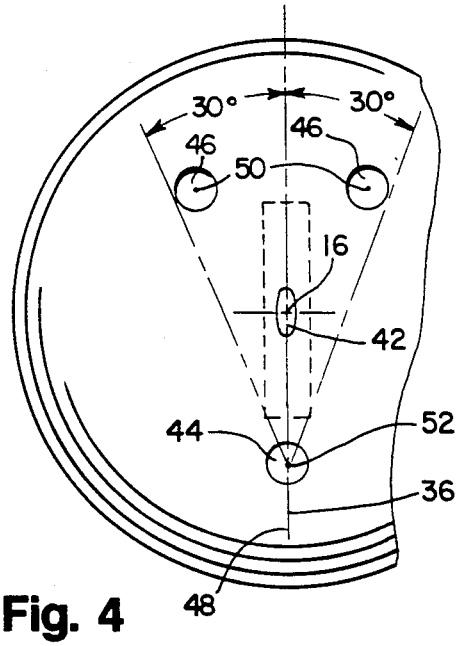
Fig. 4
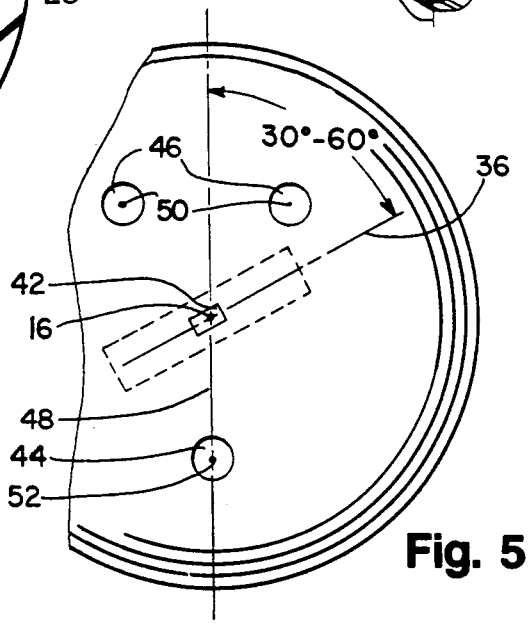
Fig. 5
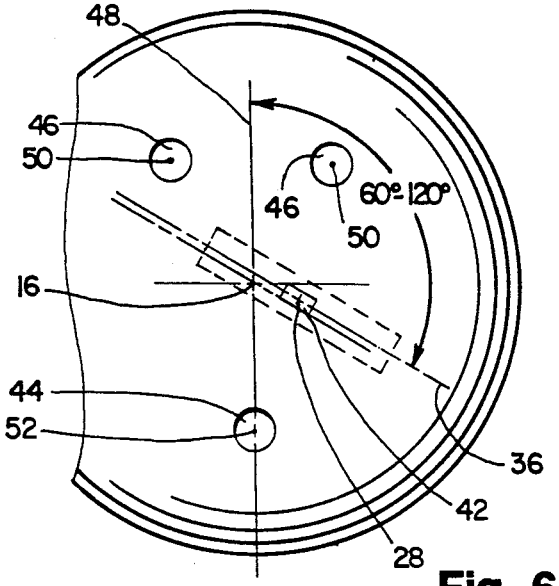
Fig. 6

METHOD OF LOCATING GRIPPING HOLES IN BOWLING BALL

This application is a division of application Ser. No. 07/612,819, filed Nov. 14, 1990 now U.S. Pat. No. 5,046,731.

BACKGROUND OF THE INVENTION

1. Field of the Invention

The present invention relates to a bowling ball and method to drill the thumb and finger holes in the same, and more particularly a bowling ball having a new weight block, indicia on the surface of the ball to locate the weight block and a method to drill the thumb and finger holes in relationship to the weight block.

2. Description of the Prior Art

Various weight blocks are known for redistributing top weight of a bowling ball primarily to offset the loss in weight resultinq from drilling the thumb and finger holes. However, none of them provide an elongate weight block along and near the surface of the ball and having another elongate section extending generally transverse from the weight block from an intermediate portion of the weight block and extending toward the center of the ball. This shape and positioning of the weight provides desired breaking of the bowling ball as it rolls down the lane with using relatively localized weighting and, at the same time, maintaining relatively dynamic stable characteristics.

In U.S. Pat. No. 4,121,828 issued Oct. 24, 1978, to Amburgey, one of the weight block configurations is a segment of an annular disk in which the minor diameter of the segment is preferably closer to the surface of the ball than the center. This structure does not have an elongate section depending transverse from an intermediate portion of the segment of the annular disk. Other configurations, as in U.S. Pat. 4,268,034, issued May 19, 1981, to MacDonald, are weight blocks preferably in the shape of a segment of a circle or relatively symmetrical members such as a cube or truncated cone. None of these weight structures provide an elongated structure near the surface of the ball having an elongate structure extending transverse to an intermediate portion of the elongated structure nearer the surface.

Various bowling balls having weighting systems include indicia on the outside of the ball to show the center of the weight and the direction of the weight. In U.S. Pat. 4,121,828, issued Oct. 24, 1978, to Amburgey and U.S. Pat. No. 4,183,527 issued Jan. 15, 1980, to Amburgey, as well, show indicia showing the central location of the gripping holes or vertical axis of the ball and indicia showing the plane of the stabilizing mass. Both of these patents teach two indicia on the surface of the ball and not how either are provided.

In U.S. Pat. No. 4,320,899, issued Mar. 23, 1982, to Salvino, an indicia is positioned on the surface of the ball to enable the drilling operator to locate the position the finger and thumb holes so as to intersect respective weight blocks. There is nothing taught as to how this indicia is provided and nothing to indicate providing center axis location of a weight block and the direction of a weight block itself.

Also, in U.S. Pat. No. 4,268,034 issued May 19, 1981, to MacDonald, an indicia of weight block is shown. However, the structure utilized provides an indicia element for the center of the weight block mass and a separate indicia element is positioned along the longitudinal axis of the weight block. Thus, the first indica locates the center of the weight block and the first with the second indicia locates the direction of the weight block.

Finally, it is known in the art to position bowling ball weight blocks in a parallel relationship to the rolling plane of the ball to provide dynamic stabilization. This is found in U.S. Pat. No. 4,121,828 issued Oct. 24, 1978 to Amburgey and U.S. Pat. No. 4,183,527 issued Jan. 15, 1980 to Amburgey, as well. Further, in U.S. Pat. No. 4,268,034 issued May 19, 1981 to MacDonald, the weight block is placed on either side of the ball for positive or negative side weighting. None of these drill the thumb and finger holes around the center axis of the weight block at a preselected angular relationship to a plane of symmetry to achieve a desired breaking point for the ball.

SUMMARY OF THE INVENTION

It is therefore an object of this invention to provide a bowling ball having a mass of preselected density and a spherical surface equidistant from a center of the spherical mass in which the improvement is a weight block of a density greater than the preselected density in which it has a first elongate section having a pair of opposite ends with an intermediate portion therebetween adjacent the spherical surface, and another elongate section having an axis of symmetry extending in a direction generally transverse of the first elongate section and extending from the intermediate portion and located between the center of the spherical mass and the first elongate section.

Another object of this invention is to provide a bowling ball having mass of preselected density and a spherical surface equidistant from a center of the mass, which has an elongate weight block having a center axis of symmetry and an imaginary symmetrical plane passing therethrough and through the center of the spherical mass and a means on the surface for marking both the center of the spherical mass and the center axis of symmetry of the weight block. The means consists of a single element having an elongate body which extends through the mass from the surface to the weight block aligned with the center axis of symmetry and carries adjacent the surface an elongate element substantially transverse of the elongate body. The elongate element having at least one elongate axis aligned with the symmetrical plane of the weight block and visible at the surface.

Another object of the invention is to provide a method of drilling a thumb and finger holes into a bowling ball having a mass of preselected density and a center and an elongate top weight block of a greater density than the preselected density with a center axis. The center axis is aligned with the center and a plane of symmetry along an elongate axis of weight block which passes through the center axis. The method includes the step of determining the location of the plane of symmetry of the weight block and drilling the thumb and finger holes into the ball around the center axis to have a preselected angular relationship to the plane of symmetry to achieve desired breaking point for the ball.

BRIEF DESCRIPTION OF THE DRAWINGS

The foregoing objects and advantageous features of the invention will be explained in greater detail and others will be made apparent from the detailed description of the embodiment of the present invention which is given with reference to the several figures of the drawing, in which:

FIG. 1 is a hemispheric sectional view of the bowling ball through an elongate plane of symmetry of the weight block;

FIG. 2 is a perspective view of the weight block;

FIG. 3 is a perspective view of a portion of the weight block of FIG. 2;

FIG. 4 is a partial top view of the bowling ball with the weight block in one angular orientation with respect to the thumb and finger holes;

FIG. 5 is a partial top view of the bowling ball with the weight block in another angular orientation with respect to the finger holes; and FIG. 6 is a partial top view of the bowling ball with the weight block in another orientation with respect to the thumb and finger holes.

DETAILED DESCRIPTION

Referring now to the drawings, in FIG. 1 is shown a hemispheric cross sectional view of bowling ball 10 having a mass 12 of a preselected density, generally composed of polyurethane or the like. Ball 10 has a spherical surface 14 which is equidistant from center 16 of mass 12.

An improvement on bowling ball 10 is weight block 18, as seen in FIG. 1, which has a greater density than the preselected density of mass 12. As shown in FIG. 2, weight block 18 has a first elongate section 20 which can generally take the form of a segment of an angular disk. Section 20. has a length substantially greater than its width, as shown in dotted lines in FIG. 5, and includes a pair of opposite ends 22, on either end, of an intermediate portion 24. Intermediate portion 24 has a surface 25 which is located adjacent surface 14. Generally, intermediate portion 24 is positioned approximately an inch from surface 14, however this distance can be varied. Generally, surface 25 is substantially concentric with surface 14.

Weight block 18 has another elongate section 26 which has an axis of symmetry 28 which is likewise generally, as well, an axis of symmetry for first elongate section 20. Section 26 is generally transverse to first elongate section 20. Section 26 extends from intermediate portion 24 of first elongate section 20 and is located between center 16 and first elongate section 20.

Opposing ends 22 of first elongate section 20 are spaced from one another by less than 45 degrees. Another elongate section 26 is generally wedge-shaped, as seen in FIG. 3, having a broad end 30 connected to first elongate section 20 and having a relatively narrow end 32 located nearest center 16.

Narrow end 32 is truncated and thereby does not dispose any portion of weight block 18 in the bottom portion of ball 10. Weight block 18 has an overall elongate outer axis 28, as described above, which approximately passes through center 16. This structure is designed to be a relatively localized weight block 18 having a very high density since it is composed of Zirconia ore or the like.

This generally wedge-like weight block 18 is of a high density material and is relatively localized in the top half of the ball. A further feature of this ball is to provide weight core 34, as seen in FIG. 1. Weight core 34 is generally composed of mineral filled polyester resin, or the like, which has a greater density than mass 12 and lesser density than weight block 18. Core 34 is generally spherical and having its center approximately located coincident with center 16. In some designs the center of weight core 34 is positioned slightly below center 16 thereby providing compensating weight on the bottom half of ball 12 to offset a portion of the weight of the combination of weight of core 34 and weight block 18 in the top half of the ball, always keeping the ball within the ABC Rule requirements.

As can be seen in FIG. 1, weight block 18 is partially embedded into weight core 34 and generally it is embedded to a depth in which first elongate section 20 is left substantially out of weight core 34.

The above described structure has produced surprising results. The ball has a relatively localized high density weight block which produces desired breaking results of ball 10 and retains dynamic stability.

This invention has a marking system for easily locating center 16 and elongate center axis 28 of weight block 18, on the outside surface 14 of ball 10. Weight block 18 has center axis of symmetry 28 which is substantially aligned with center 16 of ball 10, as described above, and has an imaginary symmetrical plane 36, as seen in FIGS. 4 and 5, passing through both center 16 and center axis 28.

This marking system has a marking means 38, as seen in FIG. 1. Marking means 38 consists of an element having an elongate body 40 which extends through mass 12 from surface 25 of weight block 18 aligned with center axis of symmetry 28. Adjacent surface 14 of ball 10, elongate body 40 carries elongate element 42 substantially transverse to elongate body 40. Elongate element 42 has at least one elongate axis aligned with symmetrical plane 36 of weight block 18. As can be seen in FIG. 4, elongate element 42 could be an oval, or in FIG. 5 it could be a rectangle or the like.

Elongate body 40 and elongate element could easily be composed of mass 12 material. Typically, this area of ball 10 would be used to support the weighting system during pouring and molding of the ball. As a results, it would be easy to pull the support out and fill it with material such as polyurethane, and a separate pouring leaves a demarkation on surface 14. Another, embodiment may consider placing a pin member in the position of body 40 and a pin head member in the position of element member 42. The pin and pin head members could be of a plastic material which would not affect weight imbalancing.

This invention provides a method of drilling thumb hole 44 and finger holes 46 into ball 10, to achieve a desired breaking point for ball 10 for a given bowler's throwing motion.

Initially, plane of symmetry 36 of weight block 18 must be located. This can easily be done with marking means 38 providing indicias 42 on the surface of the ball as discussed previously. As can be seen in FIGS. 4–6, elongate elements 42 of marking means 38 make it easy to locate plane of symmetry 36 of weight block 18 and center axis 28.

Once plane of symmetry 36 has been determined, thumb hole 44 and finger holes 46 can be drilled into ball 10 approximately around center axis 28 of weight block 18 and in a preselected angular relationship to plane of symmetry 36 to achieve the desired breaking point of the ball.

This method of drilling includes determining a grip plane 48 which can be seen in FIGS. 4–6. Grip plane 48 is established by locating on the surface of the ball axes of symmetry 50 of finger holes 46 and axis of symmetry 52 of thumb hole 44 to be drilled. Grip plane 48 is located between and approximately equidistant from axes of symmetry 50 of finger holes 46 and through axis of symmetry 52 of thumb hole 44. Grip plane 48 assists the driller in determining a preselected angular relationship between plane of symmetry 36 of weight block 18 and with thumb hole 44 and finger holes 46.

This method of drilling brings ease, and versatility to the driller. The driller orients his drilling to a preselected angular relationship of the weight block. It has been found that having the orientation between grip plane 48 and plane of symmetry 36 between +or −30 degrees, as seen in FIG. 4, will result in the break point, or the point in which it begins to curve, of the ball being relatively further down the alley for a given lane condition. The break is relatively late and quick into the desired target area the bowler desires.

A range of +30 to +60 degrees between grip plane 48 and plane of symmetry 36 as seen in FIG. 5 will provide a relatively sooner break point or one closer to the bowler than the configuration in FIG. 4. The ball reaction will have more of a hook pattern and medium distance break point down the alley.

A range of +60 to +120 degrees between grip plane 48 and plane of symmetry 36, as seen in FIG. 6, will provide an even sooner or closer to the bowler break point than the configuration in FIG. 5. The ball reaction for a given lane condition will break earlier and have generally an arc pattern.

Grip plane 48 can be located through center axis 28 of weight block 18 as shown in FIGS. 4 and 5. This drilling method incorporates more substantially only angular positioning of weight block 18 to grip plane 48. However, center axis 28 can also be positioned spaced apart from grip plane 48 to provide what is known as label shifting, as shown in FIG. 6. Label shifting can be done to improve reaction of the ball for a given throwing motion of a bowler at any preselected angular position between plane of symmetry 36 and grip plane 48.

It is generally desired to place center axis 28 substantially equidistant from axis of symmetry 52 of thumb hole 44 and a plane determined by axes of symmetry 50 of finger holes 46. Although slight variations may be desired here as well.

While a detailed description of the preferred embodiment of the invention has been given, it should be appreciated that many variations can be made thereto without departing from the scope of the invention as set forth in the appended claims.

I claim:

1. A method of locating a thumb and finger holes in bowling ball having a mass of preselected density and a center (16) and a top weight block of a greater density that the preselected density and having a center axis of symmetry (28) aligned with said center (16) and a plane of symmetry (36) which passes through said center axis (16) of said elongated weight block, said weight block having a length greater than its width in a direction perpendicular to said center axis, and said plane of symmetry passing along said length of said block:

determining the location of said plane of symmetry of the weight block; and drilling the thumb and finger holes into the ball around said center axis so that said thumb and finger balls have a preselected angular relationship only to said plane of symmetry (36) of said weight block to achieve a desired breaking point for the ball.

2. The method of claim 1 including the step of providing indicia on the surface of the ball locating the center axis of the elongate weight block.

3. The method of claim 1 including the step of providing indicia on the outside of the ball locating on the surface of the ball the plane of symmetry of the elongate weight block.

4. The method of claim 1 in which the thumb hole has an axis of symmetry and each of said finger holes has an axis of symmetry which determine a finger hole plane, said finger hole plane has a bisecting grip plane which is located between and approximately equal distance from said finger hole axes of symmetry and passes through said thumb hole axis of symmetry including the step of placing said grip plane in a preselected angular relationship to the plane of symmetry of the elongate weight block prior to drilling.

5. The method of claim 4 in which the preselected angular relationship between said grip plane and said plane of symmetry is +30 to −30 degrees.

6. The method of claim 4 in which the preselected angular relationship between said grip plane and said plane of symmetry is +30 to +60 degrees.

7. The method of claim 4 in which the preselected angular relationship between said grip plane, and said plane of symmetry is +60 to +120 degrees.

8. The method of claim 4 includes the step of locating the grip plane through the center axis of the elongate weight block.

9. The method of claim 4 includes the step of locating the grip plane spaced apart from the center axis of the elongate weight block.

10. The method of claim 4 includes locating the center axis of the elongate weight block substantially equal distance from the axis of symmetry, the thumb hole and a plane determined by the axis of symmetry of the finger holes.

* * * * *

UNITED STATES PATENT AND TRADEMARK OFFICE

CERTIFICATE OF CORRECTION

PATENT NO. : 5,149,089

DATED : September 22, 1992

INVENTOR(S) : George Zelinski

It is certified that error appears in the above-identified patent and that said Letters Patent is hereby corrected as shown below:

Col. 6, line 50, change "distance" to -- distances --

Signed and Sealed this

Twenty-first Day of September, 1993

Bruce Lehman

*Attest:*

BRUCE LEHMAN

*Attesting Officer*

*Commissioner of Patents and Trademarks*